US005168968A

United States Patent [19]

Fritze

[11] Patent Number: 5,168,968

[45] Date of Patent: Dec. 8, 1992

[54] VALENCE FOR LUGGAGE CASE

[75] Inventor: Alan C. Fritze, Evergreen, Colo.

[73] Assignee: Samsonite Corporation, Denver, Colo.

[21] Appl. No.: 638,675

[22] Filed: Jan. 8, 1991

[51] Int. Cl.[5] ..... A45C 13/04; A45C 13/36

[52] U.S. Cl. ..... 190/28; 190/122; 190/123

[58] Field of Search ..... 190/28, 121, 122, 123, 190/115, 127

[56] References Cited

U.S. PATENT DOCUMENTS

| | | | |
|---|---|---|---|
| 2,604,961 | 7/1952 | Koch | 190/28 |
| 2,758,682 | 8/1956 | Schwayder | 190/28 |
| 2,768,720 | 10/1956 | Nelson | 190/100 |
| 2,832,448 | 4/1958 | Axtell | 190/122 |
| 2,950,793 | 8/1960 | Axtell | 190/121 X |
| 3,088,623 | 5/1963 | Parker | 190/28 X |
| 3,135,366 | 6/1964 | Holtzman | 190/123 |
| 3,165,827 | 1/1965 | Stollman | 190/28 X |
| 3,194,365 | 7/1965 | Herring, Jr. | 190/122 |
| 3,198,299 | 8/1965 | Axtell et al. | 190/122 X |
| 3,306,403 | 2/1967 | Heitler et al. | 190/127 X |
| 3,698,522 | 10/1972 | Aronoff | 190/126 |
| 3,724,057 | 4/1973 | Holtzman et al. | 190/121 X |
| 3,730,309 | 5/1973 | Hamann et al. | 190/127 |
| 3,737,980 | 6/1973 | Kotkins | 190/28 X |
| 3,796,291 | 3/1974 | Cahill, Jr. | 190/115 |
| 3,920,408 | 11/1975 | Holtzman et al. . | |
| 4,199,045 | 4/1980 | Machler | 190/121 |
| 4,823,924 | 4/1989 | Goodin | 190/123 X |

FOREIGN PATENT DOCUMENTS

| | | | |
|---|---|---|---|
| 2015530 | 12/1970 | Fed. Rep. of Germany | 190/122 |
| 3248743 | 7/1984 | Fed. Rep. of Germany | 190/122 |
| 0432384 | 2/1966 | France | 190/28 |
| 1093835 | 12/1967 | United Kingdom | 190/123 |
| 1136989 | 12/1968 | United Kingdom | 190/122 |
| 1456401 | 11/1976 | United Kingdom | 190/122 |
| 2031853 | 4/1980 | United Kingdom | 190/122 |

OTHER PUBLICATIONS

Engineering drawings of valence used by Assignee in camcorder case. No date available Samsonite Corp. 112000 E. 48th Ave., Denver, Colo. 80239.

*Primary Examiner*—Sue A. Weaver
*Attorney, Agent, or Firm*—Gary M. Polumbus

[57] ABSTRACT

A valence for a luggage or carrying case includes male and female extrusions adapted to be secured to the opposing edges of the case sections. The extrusions include dual structures for positively securing the extrusions to the edges of case sections as well as mating male and female portions adapted to establish a seal between the male and female extrusions when the luggage or carrying case is in a closed condition. The frame extrusions further include structures by which accessory items such as rails can be supported in a convenient manner and for the purposes intended.

11 Claims, 3 Drawing Sheets

VALENCE FOR LUGGAGE CASE

BACKGROUND OF THE INVENTION

1. Field of the Invention

The present invention relates generally to luggage cases and is more particularly concerned with an improvement to the valence provided along the confronting edges of the two sections comprising the luggage case.

2. Description of the Prior Art

It is well known to provide a load-bearing metal valence along the peripheral edge of each of a pair of luggage case sections which are made of soft or comparatively rigid material, such as extruded aluminum or magnesium. In luggage cases of this type, the valence strips are secured to the case sections usually by rivets or by crimping the edge of the case sections into appropriate grooves in the valence.

Valences used in prior art luggage have varied dramatically with some such valences requiring that the edge of the luggage case to which the valence is attached be melted into a barbed valence to secure the valence to the edge of the case. A valence of this type is disclosed in U.S. Pat. No. 3,194,365 issued to J. M. Herring, Jr. on Jul. 13, 1965. Other valences such as of the type disclosed in U.S. Pat. No. 3,724,057 issued to Holtzman, et al. on Apr. 3, 1973 show male and female extrusions that provide a recess in a surface thereof to receive an edge of a luggage case section with the edges being secured in the grooves by conventional fasteners.

Other valences suggest that the edges of the casing be bent in order to conform with grooves or channels provided on the valence whereby upon the application of a clamping member, the valence is positively secured to the edge of the luggage case section. An example of such a valence is disclosed in U.S. Pat. No. 2,768,720 issued to E. H. Nelson on Oct. 30, 1956. The U.S. Patent to B. Shwayder granted Aug. 14, 1956 under U.S. Pat. No. 2,758,682 discloses a valence wherein a groove is provided for receiving an edge of the luggage case and a bendable arm is moved into crimping engagement with the edge of the luggage case section to secure it in the groove. The valence disclosed in the Shwayder patent is also of interest in disclosing the use of male and female mating sections along confronting edges of the luggage case sections to provide means for rigidifying the joint between the two sections.

Some valences are not as strong as would be desired and do not present an appealing aesthetic appearance both from the outside and inside of the luggage case sections. Further, the prior art confronting valence elements do not provide means for sealing the interior of the luggage case from the ambient environment. Accordingly, while prior art valences exist in numerous forms, they have not proven to be entirely satisfactory. It is to overcome the shortcomings in the prior art that the improved valence of the present invention has been developed.

SUMMARY OF THE INVENTION

The valence of the present invention consists of male and female extruded frame members which have been uniquely designed to provide a positive system for connecting the valence to the edge of a luggage case section, and, in addition, to provide convenient means for mounting, a handle, latch and locking mechanism to the valence. The valence further provides a unique system for rigidifying the engagement between the male and female extrusion frame members and in a manner such that an effective seal is established when the sections of the luggage case are closed in an engaged confronting relationship.

Each of the male and female frame extrusion members includes a web portion which defines a recess in which an edge of the luggage case section is received. Dual means are provided for securing the edge of the luggage case section in the recess with one means including a bendable arm having a crimping tooth thereon which is adapted to be moved into crimping engagement with the edge. Further, and adjacent to the recess, there are provided a plurality of longitudinally extending channels defined by parallel reinforcing flanges. The flanges have a predetermined spacing so that threaded fasteners can be passed through the edge of the luggage case sections and be self threaded into the sides of the flanges thereby providing a second means of connecting the edges of the luggage case sections to the valence members.

Each of the male and female frame members includes a barbed rib which is adapted to support and retain an auxiliary item such as, by way of example, a rail forming a skirting that overlies the connection of the valence to a luggage case section. The rib may also serve other purposes such as, for example, to facilitate retention of a liner in the luggage case or to support an insert in the luggage case of the type having pre-formed customized pockets to receive and retain various articles such as camcorders, cameras, and the like.

The male frame extrusion member has an elongated tongue projecting away from the frame extrusion in an opposite direction from its connection to an edge of a luggage case section and the female extrusion member has a complimentary and mating groove opening in an opposite direction from its connection to an opposing edge of a luggage case section. The groove in the female frame extrusion has an enlarged pocket formed in the back thereof to retain an elastomeric gasket or sealing member whereby when the luggage case sections are placed in abutting relationship, the tongue on the male frame extrusion will be seated and sealed in the groove of the female frame extrusion by engagement with the elastomeric sealing member.

Other aspects, features and details of the present invention can be more completely understood by reference to the following detailed description of a preferred embodiment, taken in conjunction with the drawings, and from the appended claims.

DESCRIPTION OF THE PREFERRED EMBODIMENT

Figure 1:
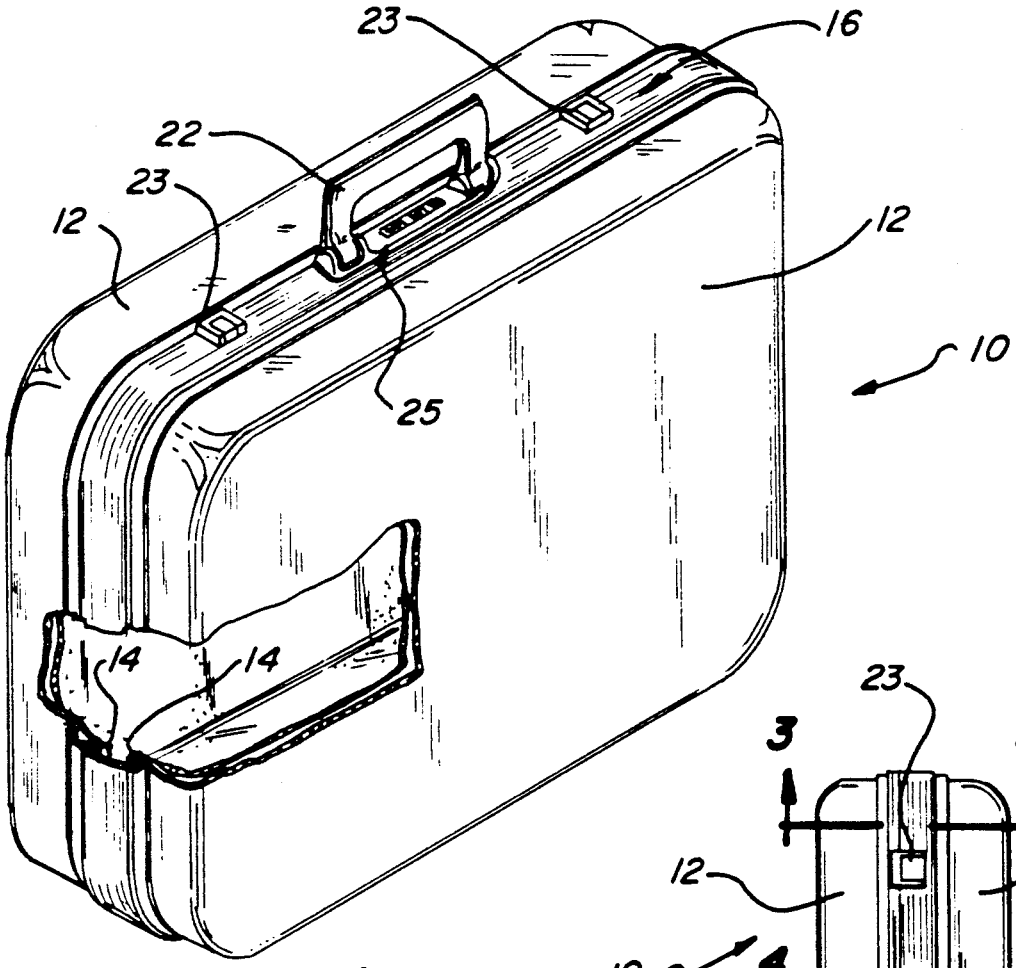
FIG. 1 is an isometric view of the luggage case incorporating the valence of the present invention with parts removed for clarity.
Figure 2:
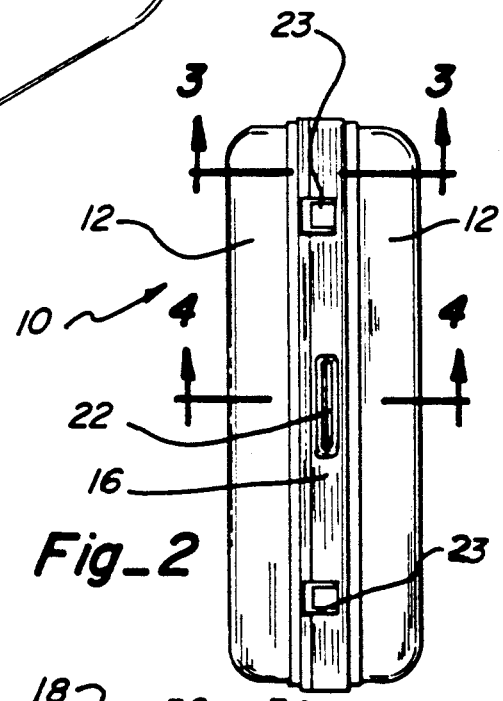
FIG. 2 is a top plan view of the luggage case shown in FIG. 1.

With reference to FIG. 1, a luggage or carrying case 10 is shown having two opposed concave rectangularly shaped sections 12 with a peripheral edge 14 on each section adapted to be moved into confronting relationship with a corresponding edge 14 on the other section. The sections 12 are hinged together along the bottom of the luggage case section in a manner which has not been illustrated but would be readily apparent to one skilled in the art.

The valence 16 of the present invention consists of two component parts being identified as male and female frame extrusions 18 and 20, respectively. The male frame extrusion 18 is adapted to extend along the peripheral edge 14 of one luggage case section while the female extrusion 20 is adapted to extend along the peripheral edge 14 of the other luggage case section. As will be appreciated with the description that follows, the valence 16 is ideally suited for establishing a sealed closure along the edges of the luggage case sections 12 and includes a location where the hinge for connecting the sections can be mounted as well as a handle 22 for the luggage case, a latch 23, and a locking mechanism 25 to secure the luggage case in a closed condition.

The male frame extrusion 18 is probably best seen in FIGS. 3, 4, 7 and 9 to include a web portion 26 and a mating portion 28. The web portion has a generally flat elongated body 30 with a plurality of longitudinally extending decorative grooves 32 formed in an outer or top face thereof. The opposite or bottom face of the body has at one side thereof, three parallel flanges 34 projecting substantially perpendicularly therefrom and in substantially parallel relationship. The flanges 34 are uniformly spaced a predetermined amount and define channels 36 therebetween for a purpose to be described hereinafter and further to serve as reinforcement for the web portion 26 of the male extrusion. The terminal edges 38 of the flanges 34 define a plane which is substantially parallel to the body 30 and as will become clear later, also to the edge 14 of the luggage case section 12 on which the male frame extrusion is mounted.

An elongated leg 40 also depends from the bottom face of the body 30 and is spaced from the innermost flange 34. As viewed in cross-section, it will be seen that the leg 40 extends substantially perpendicularly away from the body 30 of the web portion and has a relatively thick base 42 that is integral with the body 30. A relatively thin neck portion 44 of approximately one-half the width of the base 42 forms an aligned extension from the base and a rib portion 46 having a barbed head 48 forms an aligned extension from the neck portion. The barbed head defines the terminal end of the leg. As will be explained further hereinafter, the barbed head can serve several functions, one of which is to support a rail 108 which overlies and conceals the connection of the edge 14 of the luggage case section 12 to the male extrusion 18. At the juncture between the neck portion 44 and the rib portion 46, a crimp arm 50 projects at a slightly obtuse angle away from the neck portion so as to be almost or substantially perpendicular to the neck portion. The arm 50 has a crimp tooth 52 on its distal end which is directed toward the flanges 34. An indentation 54 is formed in the underside of the arm immediately adjacent to its connection with the rib portion 46 thereby defining a relatively narrow segment of the arm so that the arm can be bent as desired for a purpose to be described hereinafter.

It will be appreciated that a recess or seat 56 is defined between the crimp arm 50 and the plane defined by the terminal edges 38 of the flanges 34 with the recess being sized to receive an edge 14 of a luggage case section 12. A shoulder 58 is defined between the relatively thick base 42 and the thinner neck portion 44 of the leg 40 with the shoulder serving to engage the edge 14 of the luggage case section to help retain the male extrusion 18 in a desired position on the edge. With the edge 14 inserted into the recess 56, as seen best in FIG. 3, the crimp arm 50 can be bent toward the edge of the luggage case section to embed the crimp tooth 52 in the edge 14 thereby crimping the edge within the recess to secure the edge of the luggage case section 12 to the male frame extrusion 18.

Figure 3:
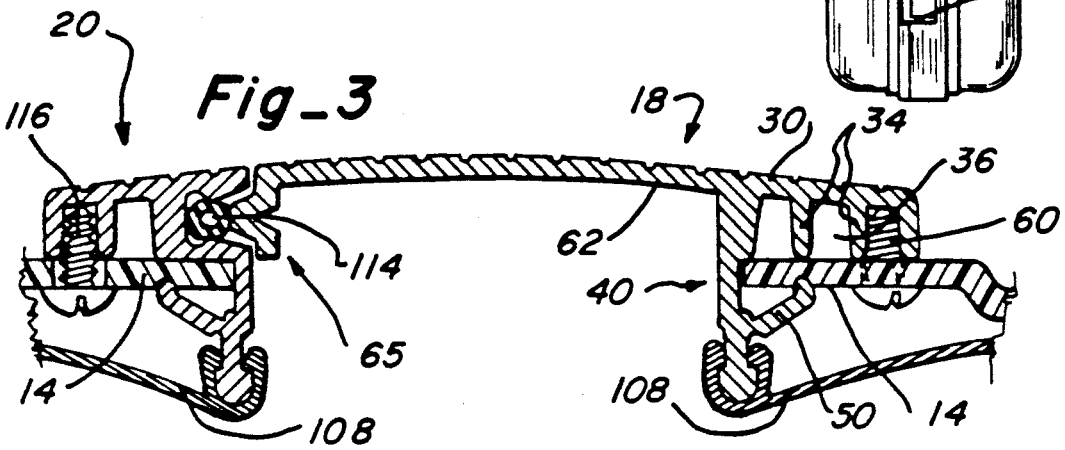
FIG. 3 is an enlarged section taken along line 3—3 of FIG. 2.

As probably also best seen in FIG. 3, threaded fasteners 60 can be extended through the edge 14 of the luggage case section 12 into the channels 36 defined between the flanges 34 and with the screw type fasteners being of a size such that the threads will engage and become self threaded in the side walls of the flanges. In this manner, it will be seen that the fasteners can be positioned at any location along the length of the male frame extrusion 18 and positively connect an edge 14 of the luggage case section 12 to the male frame extrusion.

The leg 40 projects away from the body 30 of the web portion 26 of the male frame extrusion at a location approximately one-third along the width of the male frame extrusion with the remaining approximately two-thirds of the web portion defining a mounting section 62 which is uninterrupted on the lower face of body 30 so that the lock mechanism 25, such as a combination lock, can be fastened to the web portion of the male extrusion in this area.

The side of the web portion 26 which is opposite the side on which the flanges 34 are disposed has the mating portion 28 of the male extrusion 18 integrally formed thereon. The mating portion 28 which defines a tongue 65 projects away from the underside of the relatively flat body 30 and is formed from a first leg segment 66 that extends substantially perpendicularly away from the body 30, a second leg segment 68 forming a tapered extension from the first leg segment, a third leg segment 70 forming a reverse tapered extension from the second leg segment and a fourth depending leg segment 72 extending away from the third leg segment so as to be in alignment with the first leg segment 66. The second and third leg segments 68 and 70, respectively, are convergent in a direction away from the web portion 26 of the male frame extrusion and in a direction parallel and opposite to the direction in which the recess 56 opens. It will be appreciated that in cross-section, the mating portion 28 of the male frame extrusion 18 forms a projecting tongue of trapezoidal cross-section.

Looking next at FIGS. 3, 4, 6 and 8, the female frame extrusion 20 can be seen to include a web portion 74 and a mating portion 76 with the web portion having a generally flat body 78 that is substantially narrower than the flat body 30 of the male frame extrusion 18. As with the male frame extrusion, the body 78 of the female frame extrusion has a plurality of decorative grooves 80 provided to extend longitudinally in an upper face thereof. A pair of flanges 82 project substantially perpendicularly from the underside of the body 78 at one side thereof. The flanges define channels 84 there between to facilitate a secure attachment of the female frame extrusion 20 to an edge 14 of a luggage case section 12 as described previously in connection with the male frame extension. Spaced from the innermost flange 82 a distance equal to the spacing between the pair of flanges, an integral leg 86 projects substantially perpendicularly away from the underside or bottom face of the body 78. The leg 86 has a relatively thick base 88 in which the mating portion 76 of the female frame extrusion is formed as will be described later. A relatively thin neck portion 90 forms an integral extension away from one side of the base 88. A rib portion 92 forms an integral extension away from the neck portion 90 with the rib portion 92 having a barbed head 94 forming the lower or terminal end of the leg 86. At the juncture between the neck portion 90 and the rib portion 92, a crimp arm 96 projects at a slightly obtuse angle away from the neck portion so as to form a substantially perpendicular extension. The crimp arm 96 has an upwardly directed crimp tooth 98 pointed toward the body 78 of the web portion 74. An indentation 100 is formed on the underside of the crimp arm 96 at its juncture with the rib portion to define a relatively thin segment enabling the crimp arm to be bent when desired.

It will be appreciated that a shoulder 102 is defined between the base 88 of the leg 86 and the neck portion 90 and in combination with the flanges 82 and the crimp arm 96, a recess or seat 104 is defined for receiving an edge 14 of a luggage case section. As with the male frame extrusion, the crimp arm 96 on the female frame extrusion 20 can be bent toward the edge 14 of the luggage case section to embed the crimp tooth 98 in the edge 14, thereby retaining the female frame extrusion on the edge in a crimped fashion.

Figure 4:
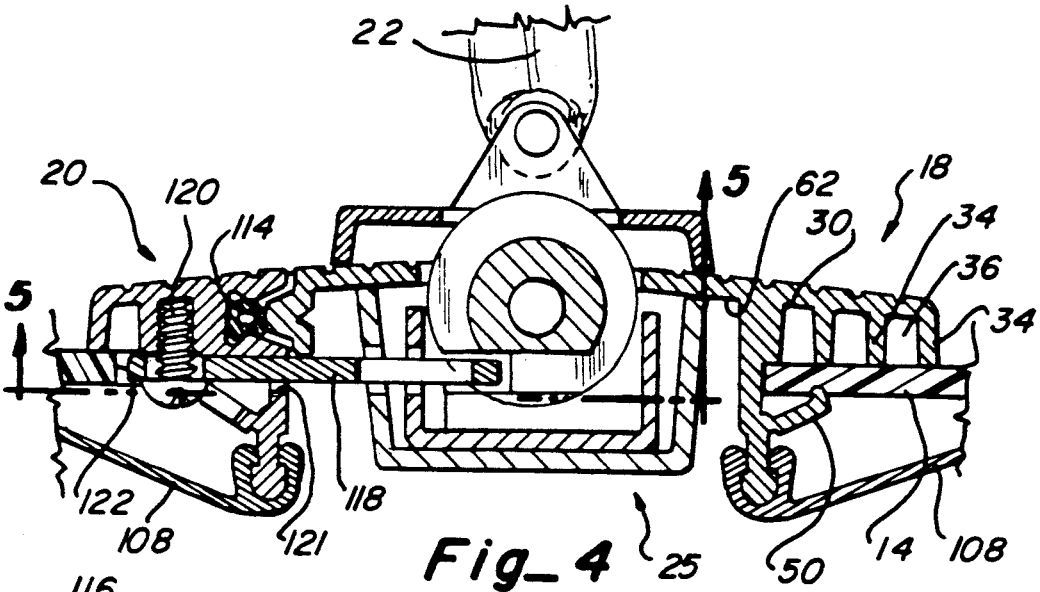
FIG. 4 is an enlarged section taken along line 4—4 of FIG. 2.

It will be appreciated that the terminal or lower edges 106 of the flanges 82 define a plane which is substantially parallel to the body 78 of the web portion 74 and also to the edge 14 of the luggage case section on which the female frame extrusion is received. The rib portion 92 on the lower end of the leg 86 is ideally suited for supporting various accessory items such as a rail 108 as illustrated in FIGS. 3 and 4, which extends across the juncture of the female frame extrusion with the edge 14 of the luggage case section. The rib portion 46 on the male extrusion 18 serves an identical purpose.

Figure 8:
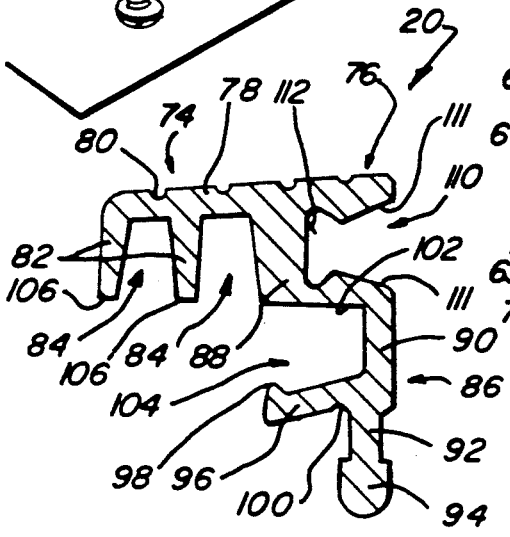
FIG. 8 is a transverse section taken through the female extrusion of the valence.
Figure 9:
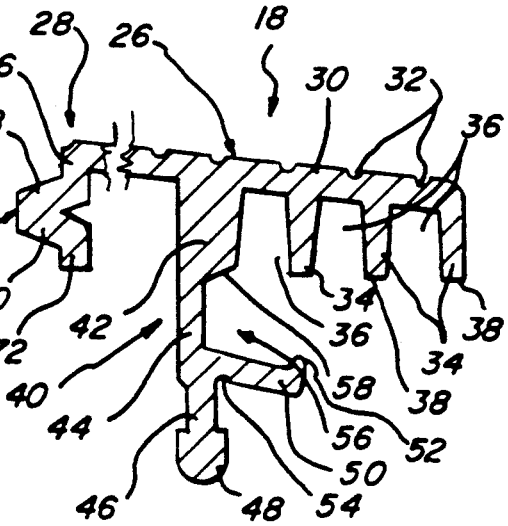
FIG. 9 is a transverse section taken through the male extrusion of the valence.

The mating portion 76 of the female frame extrusion 20 is formed in the side face of the base 88 of the leg 86 immediately above the neck portion 90 of the leg. The female mating portion 76 constitutes a groove 110 opening in a direction parallel with the body 78 of the web portion 74 but in an opposite direction from the recess 104. In cross-section, as best seen in FIG. 8, the groove 110 is generally trapezoidal, being defined by outwardly divergent sides 111 and with an enlarged recess or pocket 112 formed in the back thereof.

An elongated tubular gasket or sealing member 114 made of an elastomeric material, such as rubber or vinyl, is seated in the enlarged recess 112 and as will be explained in more clarity later, is adapted to form a sealing engagement with the tongue or mating portion 28 of the male frame extrusion 18 when the male and female extrusions are in engaged confronting relationship. The enlarged recess 112 at the back of the groove 110, of course facilitates retention of the sealing member 114 in the groove to prevent it from being inadvertently dislodged.

As with the male frame extrusion and as mentioned previously, the female extrusion 20 can be secured to an edge 14 of a luggage case section by threaded fasteners 116 extending through the edge of the luggage case section 12 and into self threaded engagement with the side walls of the flanges 82 on the underside of the body 78. It will therefore be appreciated that dual systems are provided for securing the frame extrusions 18 and 20 to the edges of the luggage case sections. Either one or both of the systems may be employed.

Figure 5:
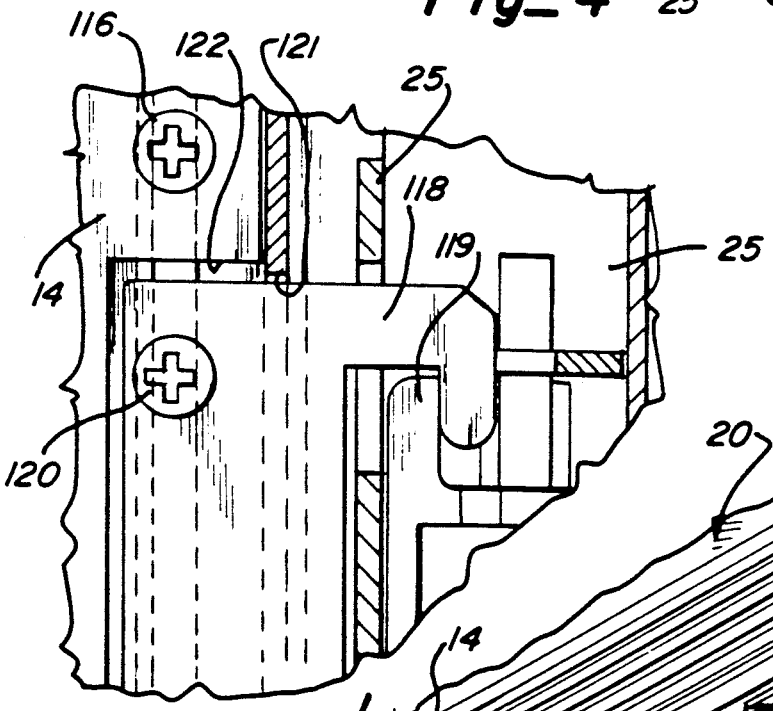
FIG. 5 is a section taken along line 5—5 of FIG. 4.
Figure 6:
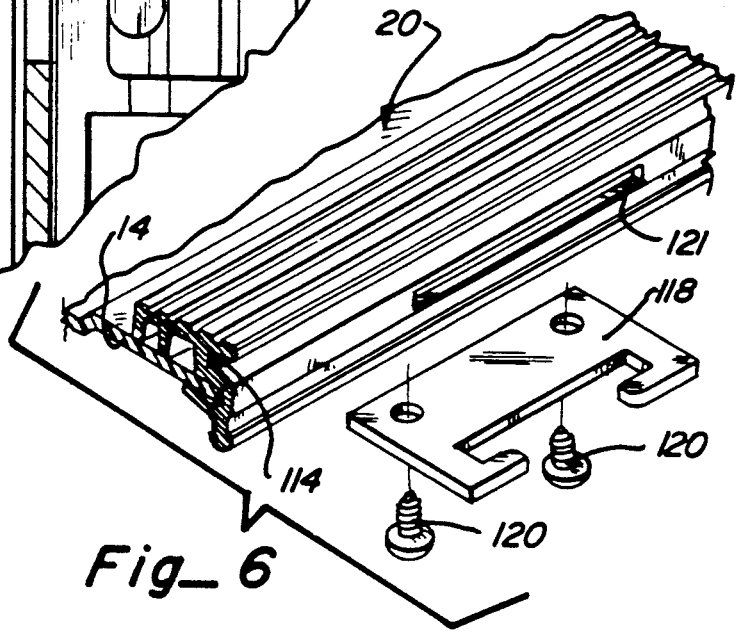
FIG. 6 is a fragmentary, partially exploded isometric view of an edge of the luggage case section having the female extrusion thereon and showing the catch of a lock mechanism.
Figure 7:
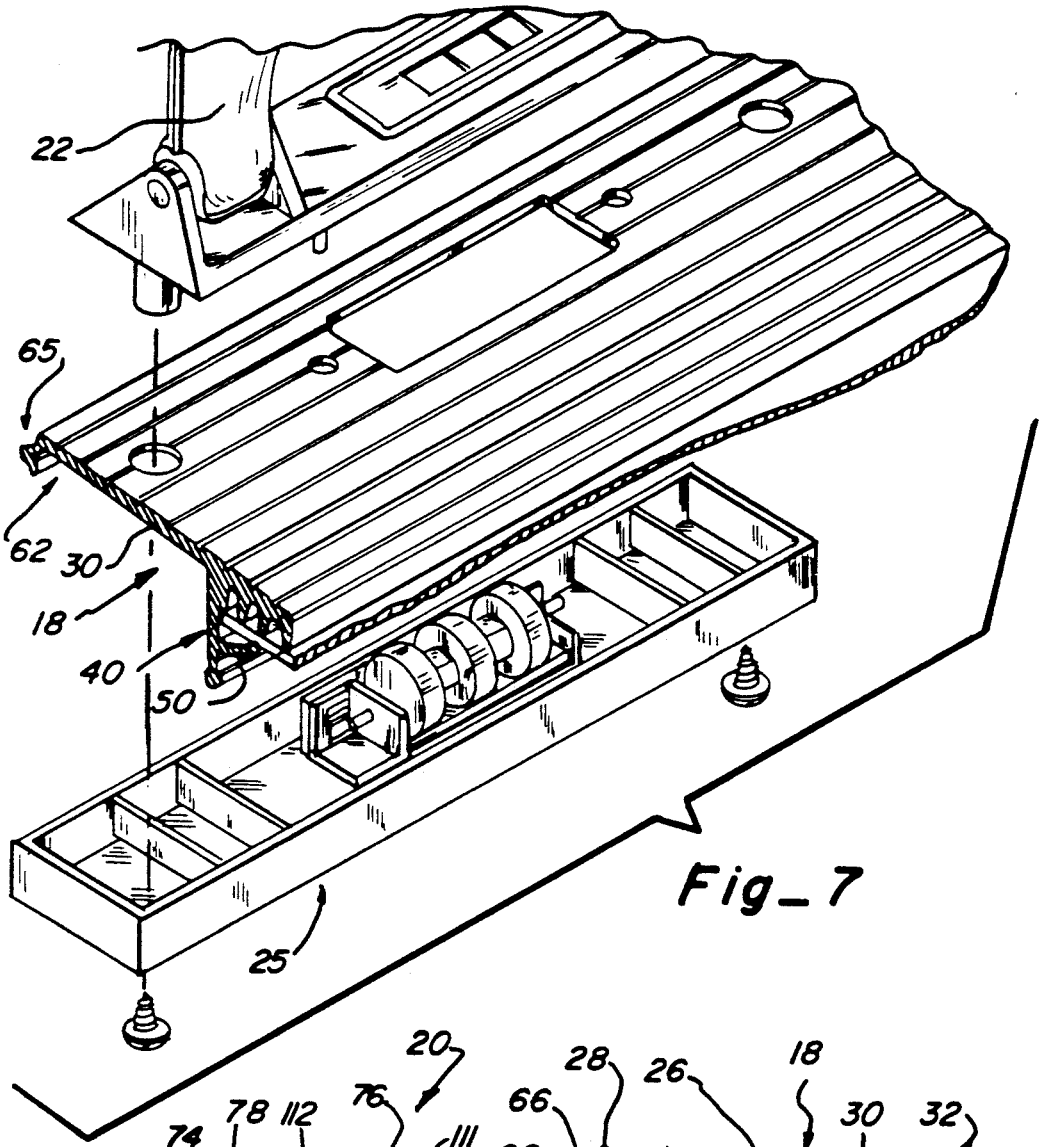
FIG. 7 is a fragmentary, exploded isometric view of an edge of the luggage case section having the male extrusion thereon and illustrating the connection of a handle and a combination lock thereto.

As mentioned previously, the mounting section 62 on the underside of the male frame extrusion 18 serves as a location in which the locking mechanism 23 or the like can be secured to the male frame extrusion. While the locking mechanism 23 does not form a feature of the present invention, it will be seen that a catch 118 (FIGS. 4 through 6) could be provided on the female frame extrusion 20 that is adapted to cooperate with conventional hook members 119 (FIG. 5) commonly found in combination locks of the type used on luggage and carrying cases. The catch 118 is attached to the female extrusion with fasteners 120 after an appropriate slot 121 is cut in the leg 86 and a notch 122 is formed in the edge 14 of the associated luggage case section 12.

With reference to FIG. 3, it can be seen that when the male and female frame extrusions 18 and 20, respectively, are moved into operative engagement, the tongue 28 on the male frame extrusion 18 is adapted to be matingly inserted into the groove 110 on the female frame extrusion 20 and will slightly engage and compress the sealing member 114 to establish a liquid-tight seal between the sections 12 of the luggage case 10. The confronting edges of the bodies 30 and 78 of each web portion of the frame extrusions will also abut immediately above the mating portions 28 and 76 of the frame extrusions so as to form a substantially continuous outer surface that is aesthetically pleasing.

It will be appreciated from the preceding description of the invention that a valence 16 for a luggage or carrying case 10 has been described that includes male and female frame extrusions 18 and 20, respectively, adapted to be matingly and sealingly engaged to provide a rigidified and aesthetically pleasing joint between the two sections 12 on which the frame extrusions are mounted. The frame extrusions have also been designed to provide a very positive system for connecting the extrusions to the edges of the luggage or carrying case sections while in addition providing means for mounting and supporting accessory items such as railing, lining for the luggage or carrying case, or for pre-formed customized trays that are frequently found in rigid walled carrying cases.

Although the present invention has been described with a certain degree of particularity, it is understood that the present disclosure has been made by way of example, and changes in detail or structure may be made without departing from the spirit of the invention, as defined in the appended claims.

I claim:

1. A valence for attachment along confronting edges of a luggage case, said valence including made and female frame extrusions, said male extrusion having a web portion and a mating means, said web portion including a recess in which an edge of said carrying case can be received and at least one channel opening substantially perpendicularly to said recess in alignment with said edge when said edge is received in said recess, said male extrusion including a relatively flat elongated body having a plurality of substantially parallel flanges projecting substantially perpendicularly from one face thereof to define at least one of said channels, each of said flanges having terminal ends which are substantially coplanar, and a leg projecting from said face of the body in substantially parallel relationship to said flanges, said leg having an arm projecting substantially perpendicularly therefrom in at least partial alignment with said flanges, said recess being defined between said arm and the terminal ends of said flanges, said flanges being spaced from each other a distance such that self-tapping fasteners of corresponding diameter which ar passed through said edge in alignment with said one of said channels can grip the flanges defining said one of said channels to secure the male extrusion to said edge, said mating means defining a tongue projecting in a direction parallel to said recess, said female extrusion having a web portion and a mating means, said web portion of the female extrusion including a recess in which a second edge of said carrying case can be received and at least one channel opening substantially perpendicularly to said recess of the female extrusion in alignment with said second edge when said second edge is received in said recess, said channel in the female extrusion having side walls which are spaced from each other a distance such that self-tapping fasteners of corresponding diameter which are passed through said second edge in alignment with said channel in the female extrusion can grip the side walls of the channel in the female extrusion to secure the female extrusion to said second edge, said mating means of the female extrusion defining a groove sized to receive said tongue and opening in a direction parallel to said recess in the female extrusion and also being aligned with the tongue of the male extrusion when the edges of the luggage case are confronting to releasably receive said tongue of the male extrusion.

2. The valence of claim 1 further including means on said arm to permit the arm to be bent relative to said leg and further including a crimp tooth on said arm directed toward said recess whereby the arm can be bent inwardly relative to said recess thereby engaging the crimp tooth with the associated edge of the carrying case to crimp the edge in the recess.

3. The valence of claim 1 wherein the mating means of said male extrusion projects in a direction parallel to said plane of the terminal ends of the flanges.

4. The valence of claim 1 wherein said leg further includes a bead-like rib, said rib including means for supporting an auxiliary item internally of the case.

5. The valence of claim 1 wherein said mating means of the male extrusion projects from said one face of said body and wherein said tongue is of generally trapezoidal cross-sectional configuration.

6. A valence for attachment along confronting edges of a luggage case, said valence including male and female frame extrusion, said male extrusion having a web portion and a mating means, said web portion including a recess in which an edge of said carrying case can be received and at least one channel opening substantially perpendicularly to said recess in alignment with said edge when said edge is received in said recess, said channel having side walls which are spaced from each other, self-tapping fasteners of a corresponding diameter to the spacing of said side walls which are passed through said edge in alignment with said channel so as to grip the side walls of said channel to secure the male extrusion to said edge, said mating means defining a tongue projecting in a direction parallel to said recess, said female extrusion having a web portion and a mating means, said web portion of the female extrusion including a recess in which a second edge of said carrying case can be received and at least one channel opening substantially perpendicularly to said recess in alignment with said second edge when said second edge is received in said recess, said web portion of the female extrusion further including a relatively flat elongated body having a plurality of substantially parallel flanges projecting substantially perpendicularly from one face thereof to define at least one of said channels in the female extrusion, each of said flanges having terminal ends which are substantially coplanar, and a leg projecting from said face of the body in substantially parallel relationship to said flanges, said leg having an arm projecting substantially perpendicularly therefrom in at least partial alignment with said flanges, said recess being defined between said arm and the terminal ends of said flanges, said one of said channels in the female extrusion having spaced side walls, threaded fasteners having a diameter corresponding to the spacing between said side walls passing through said second edge so as to grip the side walls of the channel to secure the female extrusion to said second edge, said mating means of the female extrusion defining a groove sized to receive said tongue and opening in a direction parallel to said recess in the female extrusion and also being aligned with the tongue of the male extrusion when the edges of the luggage case are confronting to releasably receive said tongue of the male extrusion.

7. The valence of claim 1 further including means on said arm to permit the arm to be bent relative to said leg and further including a crimp tooth on said arm directed toward said recess whereby the arm can be bent inwardly relative to said recess thereby engaging the crimp tooth with the associated edge of the carrying case to crimp the edge in the recess.

8. The valence of claim 6 wherein the mating means of said female extrusion opens in a direction parallel to said plane of the terminal ends of the flanges.

9. The valence of claim 1 wherein said leg further includes a bead-like rib, said rib including means for supporting an auxiliary item internally of the case.

10. The valence of claim 6 wherein said mating means of the female extrusion is disposed adjacent to said one face of said body and wherein said groove is of generally trapezoidal cross-section.

11. The valence of clam 10 further including an elastomeric sealing member seated in said groove.

* * * * *